US009974400B2

(12) United States Patent
Zuber

(10) Patent No.: US 9,974,400 B2
(45) Date of Patent: May 22, 2018

(54) SUPPORT PILLOW

(71) Applicant: Adam A. Zuber, Fort Myers, FL (US)

(72) Inventor: Adam A. Zuber, Fort Myers, FL (US)

( * ) Notice: Subject to any disclaimer, the term of this patent is extended or adjusted under 35 U.S.C. 154(b) by 168 days.

(21) Appl. No.: 15/041,142

(22) Filed: Feb. 11, 2016

(65) Prior Publication Data

US 2017/0245665 A1 Aug. 31, 2017

(51) Int. Cl.
*A47C 20/00* (2006.01)
*A47G 9/10* (2006.01)

(52) U.S. Cl.
CPC ..... *A47G 9/1045* (2013.01); *A47G 9/10* (2013.01)

(58) Field of Classification Search
CPC ..... A47G 9/10; A47G 9/1045; A47G 9/1063
See application file for complete search history.

(56) References Cited

U.S. PATENT DOCUMENTS

RE17,607 E 2/1930 Lange
3,848,281 A * 11/1974 Mathews ..... A47G 9/10 5/490
3,883,906 A * 5/1975 Sumpter ..... A47G 9/10 5/632
4,688,285 A * 8/1987 Roberts ..... A61G 7/05723 5/630
5,933,890 A 8/1999 Codd
D414,974 S * 10/1999 Marrone, II ..... 5/638
5,960,494 A * 10/1999 Gilliland ..... A61G 13/12 5/638
6,041,458 A * 3/2000 Vickers ..... A47G 9/10 5/490
6,336,236 B1 * 1/2002 Dalton ..... A47G 9/10 5/632
6,484,336 B1 * 11/2002 Berke ..... A47G 9/10 5/636
D479,083 S * 9/2003 Oates ..... D6/601
6,671,907 B1 * 1/2004 Zuberi ..... A47G 9/1063 128/845
6,745,418 B1 6/2004 Turner, Jr.
D502,038 S * 2/2005 Berke ..... D6/601
6,966,088 B1 11/2005 Hu
D575,566 S * 8/2008 Berke ..... D6/601
D588,392 S * 3/2009 Yang ..... D6/601
D636,208 S * 4/2011 Berke ..... D6/601
(Continued)

FOREIGN PATENT DOCUMENTS

JP 2003-339504 12/2003

*Primary Examiner* — David E Sosnowski
(74) *Attorney, Agent, or Firm* — Livingston Loeffler, P.A.; Edward M. Livingston, Esq.; Bryan L. Loeffler, Esq.

(57) ABSTRACT

A circular-shaped support pillow (1) having a head support (2) with a top surface (3) and a bottom surface (4). The bottom surface of the head support is preferably planar. The top surface of the head support is preferably convex, thereby curving or angling downward from an apex (6) located in the center of the head support to an outer perimeter (5) of the head support. The angled top surface of the head support positions a user's jaw in a downward angled position when the individual is laying face down on the pillow of the present invention. An optional base (7) may extend downward from the bottom surface of the head support to elevate the head support and to provide additional space for the user to place his or her arms around and/or under the perimeter edge 5 the head support.

2 Claims, 3 Drawing Sheets

(56) References Cited

U.S. PATENT DOCUMENTS

| | | | | |
|---|---|---|---|---|
| D636,209 | S * | 4/2011 | Berke | D6/601 |
| D636,210 | S * | 4/2011 | Berke | D6/601 |
| 8,176,586 | B2 | 5/2012 | Berke et al. | |
| 8,910,330 | B1 * | 12/2014 | Malik | A47G 9/109 5/636 |
| D725,942 | S * | 4/2015 | Rieber | A47C 16/02 D6/601 |
| 9,131,792 | B1 * | 9/2015 | Wagner | A47G 9/1063 |
| 9,226,605 | B1 * | 1/2016 | Castellano | A47G 9/1063 |
| D790,253 | S * | 6/2017 | Zuber | D6/601 |
| 2006/0200908 | A1 * | 9/2006 | Dalton | A47G 9/10 5/632 |
| 2010/0205743 | A1 * | 8/2010 | Harges | A47G 9/007 5/638 |
| 2010/0242179 | A1 * | 9/2010 | Berke | A47G 9/10 5/636 |
| 2016/0073802 | A1 * | 3/2016 | Davis, Jr. | A47G 9/1063 5/636 |
| 2016/0113408 | A1 * | 4/2016 | Shaffer | A47C 20/021 5/648 |
| 2017/0245665 | A1 * | 8/2017 | Zuber | A47G 9/1045 |

* cited by examiner

FIG. 1
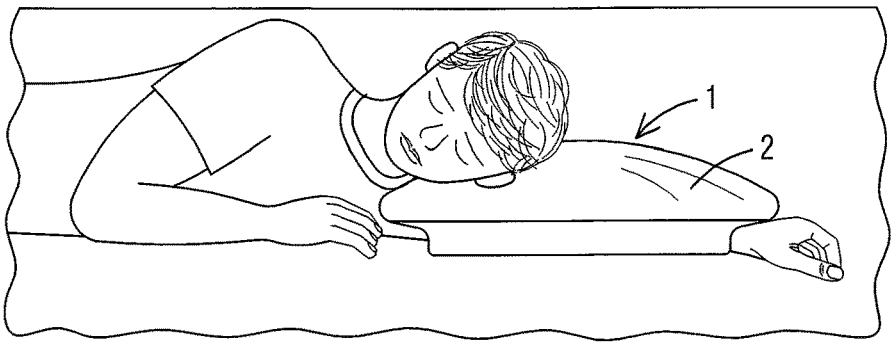
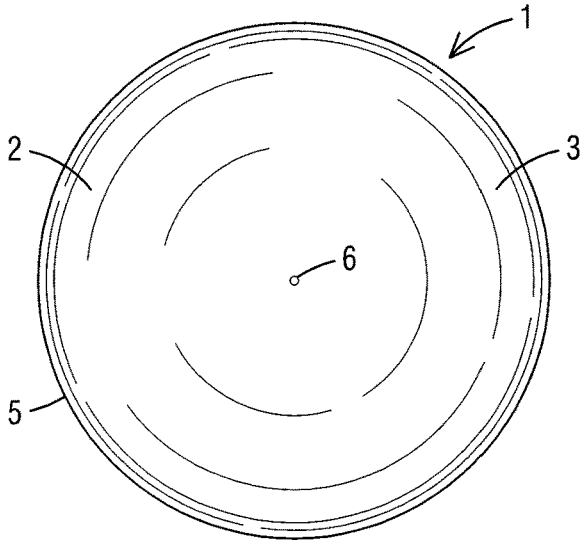
FIG. 2
FIG. 3
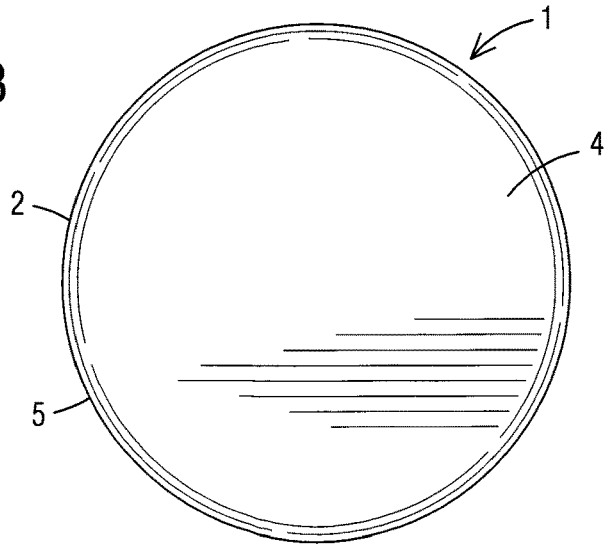

SUPPORT PILLOW

FIELD OF THE INVENTION

This invention relates to a circular-shaped support pillow having an angled top surface that supports a user's head and jaw at a predetermined angle.

BACKGROUND OF THE INVENTION

Typically, snoring while sleeping occurs in an individual who, due to his own physiology, is pre-disposed to snore upon the relaxation of various musculature around and about the individual's face and neck region, which in turn creates a set of conditions wherein a flap of tissue located in the individual's throat is caused to vibrate in synchronization with that individual's breathing. Generally, snoring tends to occur in individuals while in deep sleep at which point in time the individual's facial musculature has relaxed to the extent that said individual's jaw is moved backward.

The occurrence of snoring in many individuals can become so pronounced as to cause considerable annoyance to that individual's bedmate, even to the extreme of causing loss of sleep to such a bedmate. The problems caused by a sleeping individual's pronounced snoring have also been known to result in serious relationship disruptions, which go well beyond the loss of sleep.

There are several types of sleep apnea but in each type people with untreated sleep apnea stop breathing repeatedly during their sleep. In sleep apnea, a person's brain will briefly arouse the person from sleep in order for them to resume breathing. This results in a fragmented and poor quality sleep. An untreated sleep apnea can cause cardiovascular disease, memory problems, weight gain, stroke, headaches and high blood pressure. Sleep apnea is very common in the U.S. and can occur at any age but special risk factors include being male, overweight, and over forty years old.

Snoring is a typical symptom of individuals who experience sleep apnea. Snoring commonly occurs when an individual's musculature around the face and neck region relaxes and the jaw moves back toward the throat. Snoring cannot only be detrimental to the individual but also to the individual's bedmate.

Consequently, the alleviation of sleep apnea and snoring in a sleeping individual has been a long sought goal for many years.

Therefore, a need exists for a support pillow that maintains a user's head and jaw at a predetermined angle while sleeping to prevent sleep apnea and/or snoring.

The relevant prior art includes the following references:

| Patent No. | Inventor | Issue/Publication Date |
|---|---|---|
| RE17,607 | Lange | Feb. 25, 1930 |
| 4,688,285 | Roberts | Aug. 25, 1987 |
| 5,933,890 | Codd | Aug. 10, 1999 |
| 6,671,907 | Zuberi | Jan. 6, 2004 |
| 6,745,418 | Turner, Jr. | Jun. 8, 2004 |
| 6,966,088 | Hu | Nov. 22, 2005 |
| D575,566 | Berke et al. | Aug. 26, 2008 |
| 8,176,586 | Berke et al. | May 15, 2012 |
| JP2003-339504 | N/A | Dec. 2, 2003 |

SUMMARY OF THE INVENTION

The primary object of the present invention is to provide a support pillow that supports a user's head and jaw at a predetermined angle.

An additional object of the present invention is to provide a support pillow that does not interfere with placement of the individual's arms above his or her head.

The present invention fulfills the above and other objects by providing a mushroom-shaped support pillow having a circular-shaped head support with a bottom surface and a top surface. The bottom surface of the head support is preferably planar or flat. The top surface of the head support is preferably convex, thereby curving or angling downward from an apex located in the center of the head support to an outer perimeter of the head support. The angled top surface of the head support positions a user's jaw in a downward angled position when the individual is laying face down on the pillow of the present invention.

An optional base may extend downward from the bottom surface of the head support. The base preferably has a width (if rectangular) or diameter (if circular) that is less than that of the head support. The base elevates the head support to a desired height and provides more space for the user to place his or her arms around and/or under the head support.

The head and jaw support pillow of the present invention may also have an optional feature of one or more integrated speakers or a recessed area within the body of the pillow to place one or more objects, such as an electronic music device, mp3 player, iPod, iPhone, sound machine, scent packet, religious artifacts, vibration device, snoring detector, apnea detector, oximeter, alarm and so forth.

The support pillow of the present invention may be made of foam or similar materials having one or more levels of density.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which:

FIG. 1 is a perspective view of a support pillow of the present invention in use;

FIG. 2 is a top view of a support pillow of the present invention;

FIG. 3 is a bottom view of a support pillow of the present invention;

DESCRIPTION OF THE PREFERRED EMBODIMENTS

Figure 4:
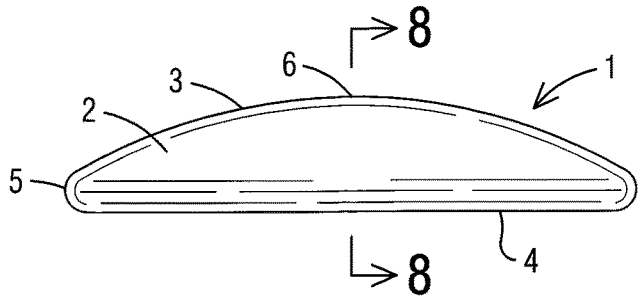
FIG. 4 is a side view of a support pillow of the present invention.

For purposes of describing the preferred embodiment, the terminology used in reference to the numbered components in the drawings is as follows:

1. support pillow, generally

2. head support
3. upper surface of head support
4. bottom surface of head support
5. perimeter edge of head support
6. apex
7. base
8. diameter of the base
9. diameter of the head support
10. overhang
11. bottom surface of base
12. side wall of base
13. recessed area With reference to FIG. 1, a perspective view of a support pillow 1 of the present invention in use is illustrated. The support pillow comprises a head support 2 having an angled top surface 3 that supports an individual's head and jaw at a predetermined angle when the individual is laying face down on the support pillow 1. The circular shape of the support pillow 1 and head support 2 allows the individual to freely place one or more arms above his or her head directly on the surface of the bed without being trapped under the support pillow 1 and/or being angled over the support pillow 1.

With reference to FIGS. 2-4, a top, bottom and side view, respectively, of a support pillow 1 of the present invention are illustrated. The support pillow 1 of the present invention comprises a circular-shaped head support 2 having a top surface 3, a bottom surface 4 and a perimeter edge 5. The bottom surface 4 of the head support is preferably planar or flat. The top surface 3 of the head support 2 is preferably convex, thereby curving or angling downward from an apex 6 located in a center of the circular-shaped head support 2 to the outer perimeter edge 5 of the head support 2, thereby creating a preferably spherical or rounded cone shape. The angled top surface 3 of the head support 2 positions a user's jaw in a downward angled position when the individual is laying face down on the support pillow 1, as illustrated in FIG. 1.

Figure 5:
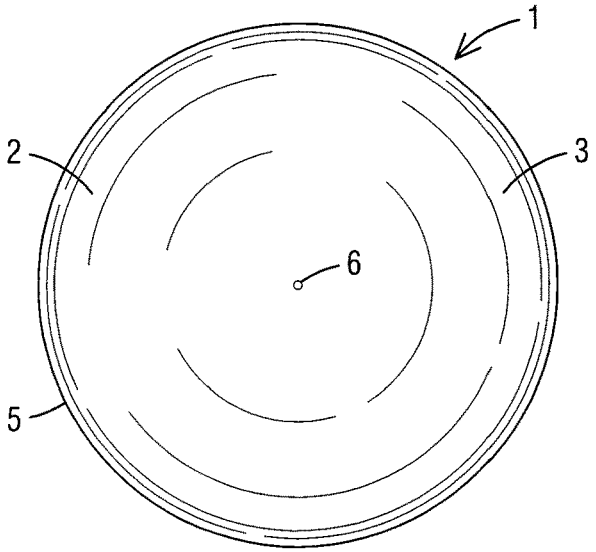
FIG. 5 is a top view of a support pillow of the present invention having a base.
Figure 6:
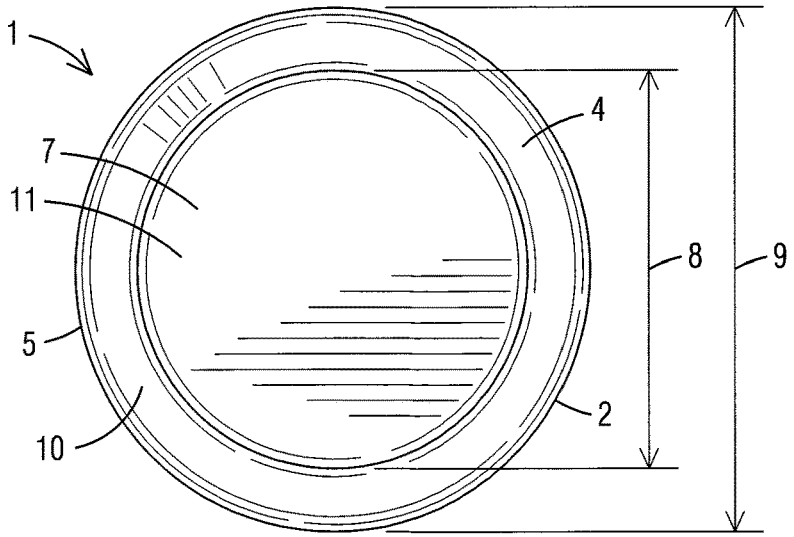
FIG. 6 is a bottom view of a support pillow of the present invention having a base.
Figure 7:
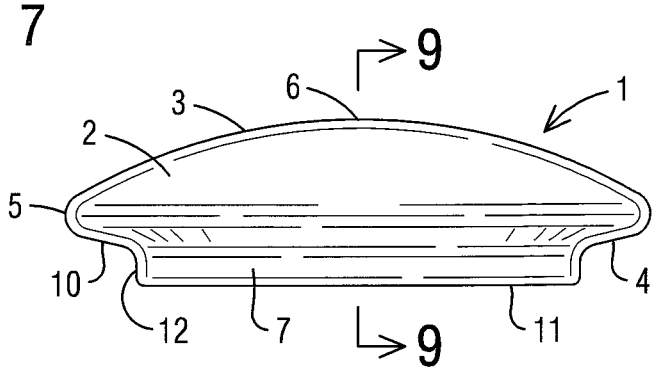
FIG. 7 is a side view of a support pillow of the present invention having a base.

With reference to FIGS. 5-7, a top, bottom and side view, respectively, of a support pillow 1 of the present invention having a base 7 are illustrated. The support pillow 1 of the present invention comprises a circular-shaped head support 2 having a top surface 3, a bottom surface 4 and a perimeter edge 5. The bottom surface 4 of the head support 2 is preferably planar or flat. The top surface 3 of the head support 2 is preferably convex, thereby curving or angling downward from an apex 6 located in a center of the circular-shaped head support 2 to the outer perimeter edge 5 of the head support 2, thereby creating a preferably spherical or rounded cone shape. The angled top surface 3 of the head support 2 positions a user's jaw in a downward angled position when the individual is laying face down on the support pillow 1, as illustrated in FIG. 1.

As illustrated her, a base 7 extends downward from the bottom surface 4 of the head support 2. The base 7 elevates the head support 2 to a desired height. The base 7 preferably has a width (if rectangular) or diameter 8 (if circular) that is less than the diameter 9 of the head support 2, thereby creating an overhang 10 that provides additional space for the user to place his or her arms around and/or under the perimeter edge 5 of the head support 2. The base 7 comprises a bottom surface 11 that is preferably planar or flat and perimeter side wall 12. The base 7 is preferably centered on the bottom surface 4 of the head support 2 so that the overhang 10 is located around the entire circumference of the support pillow 1.

Figure 8:
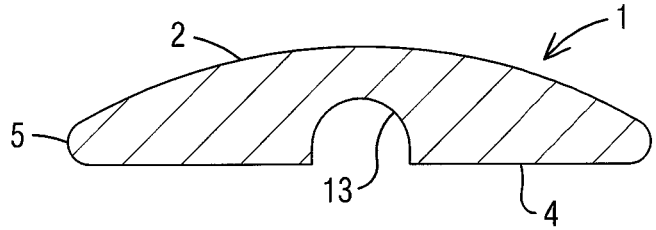
FIG. 8 is a cross sectional side view along line 8-8 of FIG. 4 of a support pillow of the present invention.

With reference to FIG. 8, a cross sectional side view along line 8-8 of FIG. 4 of a support pillow 1 of the present invention is illustrated. The support pillow 1 of the present invention may also comprise an optional feature of one or more integrated speakers or a recessed area 13 within the support pillow 1 to place an electronic device, such as an mp3 player, iPod, iPhone, sound machine or so forth. The recessed area 13 may be accessed from the bottom surface 4 of the head support 2.

Figure 9:
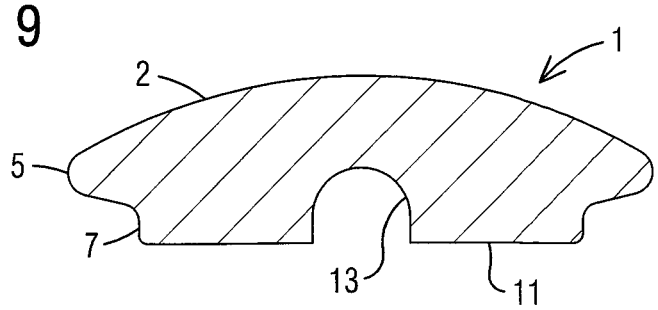
FIG. 9 is a cross sectional side view along line 9-9 of FIG. 7 of a support pillow of the present invention having a base.

With reference to FIG. 9, a cross sectional side view along line 9-9 of FIG. 7 of a support pillow 1 of the present invention having a base 7 is illustrated. The support pillow 1 of the present invention may also comprise an optional feature of one or more integrated speakers or a recessed area 13 within the support pillow 1 to place an electronic music device, such as an mp3 player, iPod, iPhone, sound machine or so forth. The recessed area 13 may be accessed from the bottom surface 11 of the base 7.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

Having thus described my invention, I claim:

1. A support pillow comprising:

a circular-shaped head support having a top surface, a bottom surface and a circular perimeter edge;

said top surface of the head support having a convex cone shape wherein the top surface angles downward from an apex located in a center of the circular-shaped head support to the circular perimeter edge of the head support;

a single circular base having a planar bottom surface and a perimeter side wall extending downward from the bottom surface of the head support to the bottom surface of the circular base and fully around a circumference of the circular base;

said circular base having a diameter that is less than a diameter of the head support, thereby creating an overhang created by the circular perimeter edge extending beyond the perimeter side wall of the base wherein said overhang extends around a circumference of the head support; and an arcuate recessed area generally centrally located within the circular base, said recessed area extending upward from the planar bottom surface of the circular base into at least a portion of the head support.

2. The support pillow of claim 1, wherein said recessed area is configured to receive an object.

* * * * *